US005715927A

United States Patent [19]

Brandt

[11] Patent Number: 5,715,927

[45] Date of Patent: Feb. 10, 1998

[54] ANTI-JAMMING TOKEN COLLECTING APPARATUS FOR SLOT MACHINES

[76] Inventor: Ronald A. Brandt, 374 Revere Rd., Smithville, N.J. 08201

[21] Appl. No.: 640,097

[22] Filed: Apr. 30, 1996

[51] Int. Cl.[6] ..... G07F 1/04

[52] U.S. Cl. ..... 194/344; 194/350; 193/30

[58] Field of Search ..... 194/344, 350; 193/30, DIG. 1; 232/7, 12, 15, 16; 285/302

[56] References Cited

U.S. PATENT DOCUMENTS

| | | | |
|---|---|---|---|
| 1,706,896 | 3/1929 | Mills . | |
| 1,965,858 | 7/1934 | Phare | 194/252 |
| 2,072,505 | 3/1937 | Knee | 194/302 |
| 2,298,119 | 10/1942 | Gebert | 193/30 X |
| 2,580,752 | 1/1952 | Forester | 232/15 |
| 3,018,868 | 1/1962 | Antonoff | 194/239 |
| 3,653,586 | 4/1972 | Bonneson | 232/15 X |
| 3,907,334 | 9/1975 | Schera | 285/302 X |
| 4,773,648 | 9/1988 | Itoh | 273/143 R |
| 5,088,587 | 2/1992 | Goodrich | 194/345 |
| 5,390,923 | 2/1995 | Takemoto et al. | 273/148 |

*Primary Examiner*—F. J. Bartuska
*Attorney, Agent, or Firm*—Abelman, Frayne & Schwab

[57] ABSTRACT

The problem of jammed slot machine tokens at the entry to the slot machine collection box is alleviated by providing an outer tube which can telescope about a concentrically disposed fixed, inner tube in response to the release of a device locking the two tubes together to provide sufficient clearance between the termini of the tubes and the collection box to allow the tokens to be freed from their jammed condition and permit ready removal of the filled collection box and insertion of an empty collection box.

4 Claims, 2 Drawing Sheets

ANTI-JAMMING TOKEN COLLECTING APPARATUS FOR SLOT MACHINES

FIELD OF THE INVENTION

The invention relates to an improved token or coin release mechanism for mechanical, electrical, or electronic slot machines and, more particularly, to a device to readily alleviate the problem of jammed or accumulated coins or tokens at the entrance to the slot machine coin or token collection box.

BACKGROUND OF THE INVENTION

At gambling casinos throughout the world, and particularly in the United States, one of the most significant contributors to profit are the ubiquitous slot machines. Slot machines can be mechanical in nature, or electromechanical, or electronic. They will accept coins, such as nickels, dimes, quarters and half-dollars, as well as tokens. Typically tokens are used in high denomination games wherein a token or disc is used in lieu of government minted coins. One finds tokens being used in lieu of $1, $5 and $10 dollar bills, or even larger denomination bills, such as, for example, $25, $50, $100 and $500.

These larger denomination tokens usually have a greater circumference and also weigh a great deal more than either coins or low denomination tokens. When such large denomination tokens are used they often create jamming or backing-up problems at the entrance to the drop box or collection box, which is located on the underside of the slot machine, for excess tokens which have been diverted from the slot machine hopper.

Initially, as one plays the slot machine, the tokens employed are either delivered to the internal hopper after entering the slot machine until a sufficient number of tokens are in the internal hopper and thereafter they are diverted into the drop box or collection box. At such time as a winning combination appears, the hopper pays out a monetary return to the winning slot machine player. Those tokens which do not drop into the hopper portion, namely, excess tokens, fall into the "drop portion" of the slot machine and then into the "drop box" or collection box.

Periodically, in accordance with a predetermined schedule, the filled drop boxes or collection boxes are removed, the contents counted and an empty drop box is inserted in lieu of the removed drop box.

However, in removing the filled slot machines collection boxes, especially those utilizing the aforementioned large circumference, heavy tokens, where there is often a great deal of activity especially over the weekends, conditions quite often arise where the drop box is completely filled prior to the scheduled removal time and the large tokens begin to back-up in the exit chute which forms the entry path into the collection box. Once this clogging or jamming condition occurs, the slot machine will tilt and the customer's play is stopped automatically.

There then ensues a procedure wherein the casino control commission must intervene, along with casino security and various other functionaries in the casino. At this point in time, secured keys must be used to open the drop box in order to remove the filled drop box and replace it with an empty one. Due to the weight of the column of tokens in the chute which are pressing down on the drop box, it is often very difficult to readily remove the completely filled drop box, thus creating a problem of lost revenues due to machine down-time, as well as inordinate delay in allowing the customer to resume playing that slot machine. Since the player oftentimes wants to continue to play on the same slot machine without interruption, the lost time involved in emptying the machines and in removing the jammed tokens, results in slot machine down-time which can take up to an hour, or in certain instances, even longer to correct. As a result, the customer is inconvenienced and may even leave the casino, resulting in loss of revenues due to the inoperability of the machine during this forced downtime. Thus, the net result from jammed or clogged token collection boxes are at least two-fold, namely, disgruntled patrons and lost revenues to the casino.

Accordingly, it is an object of the present invention to provide an improved exit chute which will forestall jamming and clogging of the chute by coins or tokens and which will allow ready and easy removal of the drop box or collection box without significantly interrupting play on the slot machine.

SUMMARY OF THE INVENTION

By means of the apparatus of the present invention, jamming or backing-up of tokens between the slot machine collection box and the exit chute which communicates with an opening in the collection box is simply and inexpensively overcome while avoiding the problems associated with slot machine down-time, namely, customer dissatisfaction and lost revenues.

The anti-jamming token collection apparatus of the present invention, which is located at the entry to the slot machine collection box, comprises:

a) a removable token collection box adapted to receive at least a portion of the tokens presented for play;

b) a conduit for routing tokens from the inner volume of the slot machine to the token collection box;

c) said conduit including a token chute which comprises an upper member having a funnel-like configuration and communicating downstream thereof with a longitudinally extending fixed first tubular member;

d) the terminal edge of said fixed first tubular member disposed proximate and in substantial registry with an aperture in said token collection box; and e) a longitudinally extending second tubular member concentrically disposed about said first, fixed tubular member and lockingly engaged therewith by a selective locking member, said first and said second tubular members forming inner and outer sleeves, respectively, said outer sleeve having a greater diameter then said fixed inner sleeve thereby allowing the outer sleeve to move telescopically in response to the opening of the selective locking member which serves to engage said inner and outer sleeves whereby tokens jammed in said token chute are free to fall in response to the disengagement of the two sleeves permitting the outer sleeve to telescope relative to the fixed, inner sleeve to provide sufficient clearance for removal of the filled token collection box.

Sufficient clearance or spacing is thus created between the termini of the communicating inner and outer sleeves and the upper surface of the collection box to facilitate the ready removal of the collection box from the bottom of the slot machine housing. The collection box is thus readily removable and easily replaceable with an empty collection box allowing resumption of slot machine play in a matter of minutes. As a result, casino revenues are increased and customer relationships are enhanced. immeasurably.

Features of the present invention which are believed to be novel and unobvious are particularly pointed out in the concluding portion of the present specification. The invention, however, together with further objects and advantage thereof, may best be appreciated by reference to the following detailed description when taken in conjunction with the drawings described hereinafter.

DETAILED DESCRIPTION OF THE INVENTION

Figure 1:
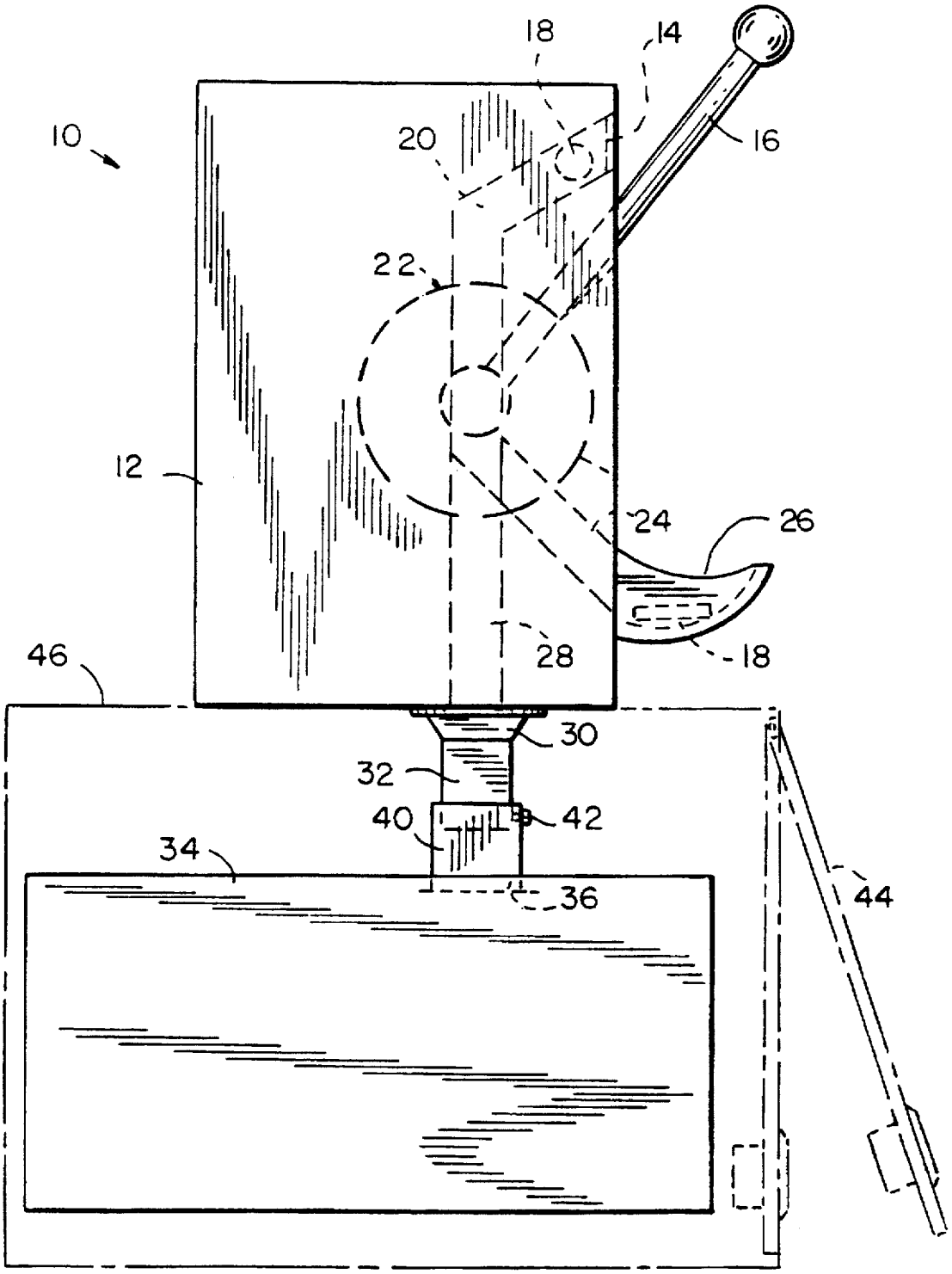
FIG. 1 is a side view of a typical slot machine, including the anti-jamming device of the present invention.

Referring now to FIG. 1 of the drawings, a slot machine generally designated as 10, includes a housing 12, a token insertion slot 14, and a handle or lever 16, which can be activated mechanically, electrically or electronically. As a token 18 is deposited into the token insertion slot 14 and the handle or lever 16 is activated, the token 18 moves downwardly through a passageway 20 and enters into a combined collection/payout device 22.

Some of the tokens 18 present in the collection/payout mechanism 22 will be delivered into a channel 24 which is in communication with the collection/payout mechanism 22 and with a hopper 26. The hopper 26 is that portion of the slot machine 10 which stores and pays out coins or tokens to a winning player when the hopper has accumulated a predetermined number of coins or tokens. Additional coins or tokens exiting from the collection/payout mechanism 22 are diverted into a conduit or channel 28 where they are routed to a communicating funnel-like member 30 and, in turn, to a communicating, downstream, fixed, first tubular member 32, to form a token drop chute or token exit chute leading into a token collection box or drop box 34. The first tubular member 32 can be made, for example, of a rigid plastic, such as polyvinyl chloride.

In accordance with the present invention, the first tubular member 32 is proximate the upper surface of the token collection box 34 and is in substantial registry with an opening or aperture 36 provided therein which allows the tokens to pass into the collection box. The aperture 36 has a spring loaded trap door 37 (see FIGS. 3 and 4) which remains open while the collection box is being filled with tokens, but which is supposed to close when the collection box is filled.

Figure 2:
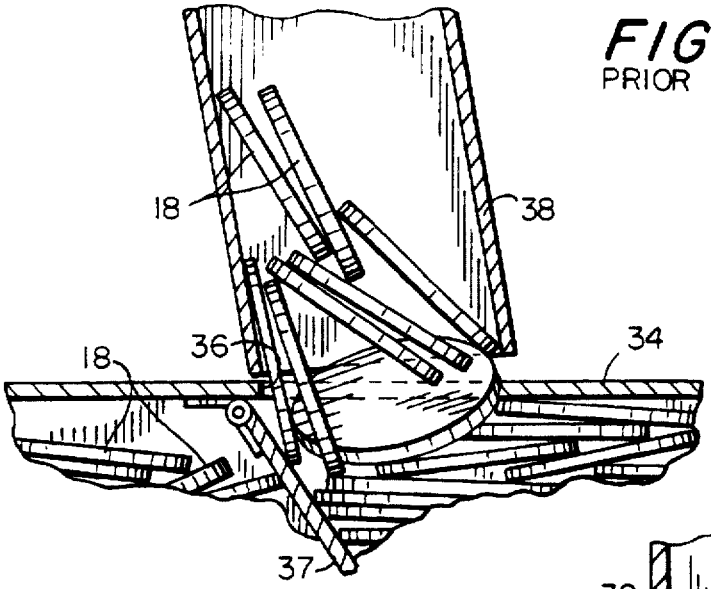
FIG. 2 PRIOR ART
FIG. 2 is a partial, enlarged cross-sectional view of a jammed collection box in accordance with the prior art.

As can be seen by reference to FIG. 2, in the prior art there was only a fixed, angularly disposed, tubular member 38, which communicated with upstream funnel 30, as shown in FIG. 1. Tubular member 38 was at an angle of about 10° to about 25°. Thus, the diverted tokens 18 would first enter funnel 30, and then pass into elbow 38. The terminal edge of elbow 38 was positioned in a near abutting relationship with respect to the aperture 36 of collection box 34. As a result, when a large quantity of oversized tokens had accumulated in the collection box 34, they would clog the opening 36 and prevent trap door 37 from closing, resulting in a column of backed-up tokens in the elbow 38 and, eventually, even backing-up into funnel 30. When it came time to remove the filled collection box 34, the pressure of the wedged, overlying tokens made its removal very difficult, oftentimes requiring protracted pulling and prying, both manually and with instruments, in an effort to dislodge and remove the filled collection box.

Figure 3:
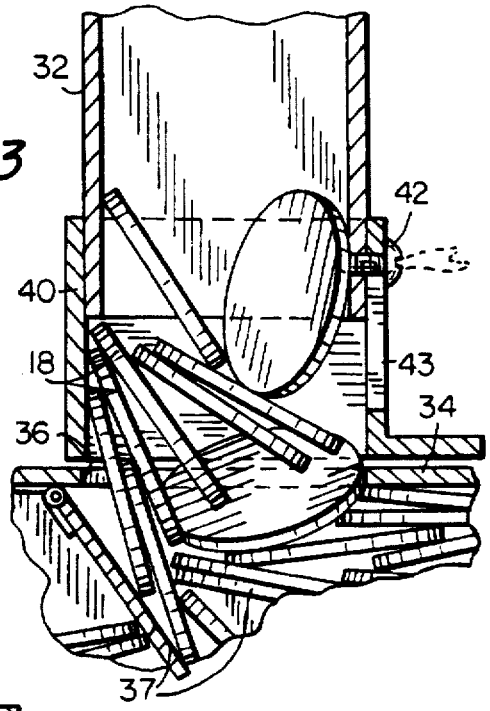
FIG. 3 is a view similar to FIG. 2 with the new longitudinally movable outer sleeve of the present invention depicted prior to releasing the jammed coins or tokens.
Figure 4:
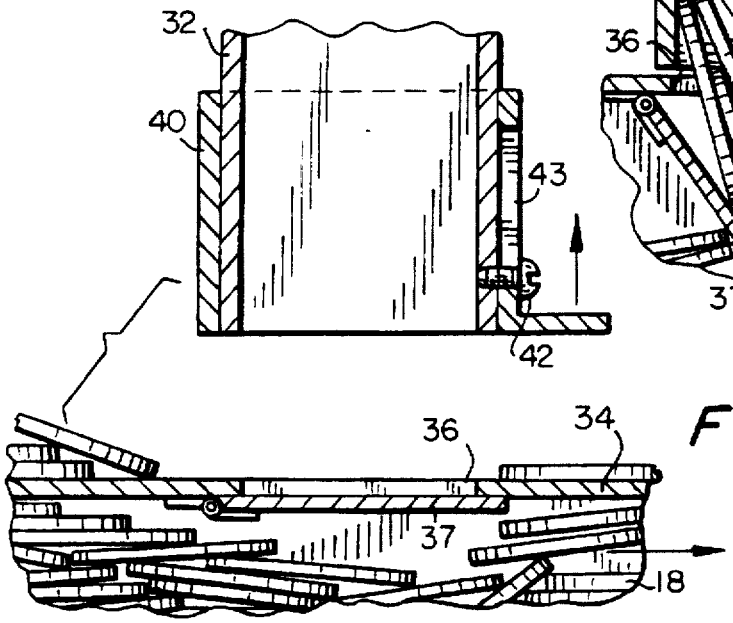
FIG. 4 depicts the outer sleeve of the present invention in the raised or telescoped attitude with the jammed coins or tokens cleared.

With reference to FIGS. 1, 3 and 4, in accordance with the present invention a concentric, longitudinally extendible, second tubular member 40, which has a greater diameter than the first tubular member has been provided, and it is disposed about said first tubular member 32 which is substantially perpendicular with respect to the opening 36 in collection box 34. There is no, angle in tube 32. The second tubular member 40, which is fabricated from the same material as the first tubular member, for example, polyvinyl chloride, and the first tubular member are lockingly engaged by means of an adjustable locking member, shown as a set screw, 42. The locking member or mechanism can also be a bolt, a thumb screw, or any of a variety of locking mechanisms. It can, in fact, be any type of locking device which will allow the second tubular member 40 to remain in a stationary, fixed position relative to the first tubular member during the usual and ordinary operation of the slot machine 10, but will be of such construction as to permit casino personnel to simply and conveniently unlock the screw 42, with a tool, such as a screw driver, shown in phantom in FIG. 3, to permit the second tubular member 40 to telescope upwardly or longitudinally in slot 43. A keyed access door 44 is provided in the side of a lower or base housing 46 of the slot machine 10 in order to gain entry and access to the drop box 34.

Once the second tubular member is telescoped upwardly and is no longer in contact with or proximate the surface of collection box 34, sufficient clearance is provided to permit collection box 34 to be removed through access door 44 without disrupting play on the machine for any significant period of time. The heretofore jammed tokens are now free to fall onto the surface of the collection box and on the floor of the slot machine housing 46, resulting in an unclogged condition. The excess tokens on the floor of slot machine housing 46 are manually collected and inserted, under supervision, into an empty collection box which is inserted in lieu of the filled collection box which has been removed.

It can be seen in FIG. 3 that the second tubular member 40 forms an outer sleeve about the first tubular member 32, with locking adjustment member 42 connecting the first and second tubular members. As depicted, the tokens have completely filled the collection box 34 to overflowing and have now backed up within the confines of the first tubular member or inner sleeve 32.

With reference to FIG. 4, after loosening locking member 42, the second tubular member 40 can be moved upwardly in a slot 43 provided therein. The terminal edge portion of second tubular member 40 is now at substantially the same height as the terminal edge of first tubular member 32. As a result, sufficient clearance or spacing has been created between the upper surface of collection box 34 and the termini of first and second tubular members 32 and 40, which results in alleviating or breaking the token backup or jam and permits the collection box to be readily removed through access door 44 in base housing 46.

Accordingly, by employing the apparatus of the present invention, the removal of a filled token collection or drop box can be accomplished readily and expeditiously without causing any disruption in play or lost revenues due to slot machine down-time.

It is to be understood that the invention is not limited to the exact details of construction, operation or exact materials or embodiments shown and described, as obvious modifications and equivalents will be apparent to one skilled in the art, and the invention is therefore to be limited only by the scope of the appended claims.

What is claimed is:

1. An anti-jamming token collection device for slot machines, which comprises:

(a) a removable token collection box adapted to receive at least a portion of the tokens presented for play;

(b) a conduit means for routing tokens from the inner volume of the slot machine to said token collection box;

(c) said conduit means including a token chute means comprising an upper member having a funnel like configuration and communicating downstream thereof with a longitudinally extending fixed first tubular member;

(d) the terminal edge of said fixed first tubular member disposed above and substantial registry with an aperture of said token collection box; and (e) a longitudinally extending second tubular member disposed concentrically about said first tubular member and lockingly engaged therewith by a selective locking means, said first and second tubular members forming inner and outer sleeves, respectively, said outer sleeve having a greater diameter than said fixed inner sleeve and including a slot provided in said outer sleeve to allow it to telescope upwardly upon disengagement of the selective locking means between the inner and outer sleeves whereby jammed tokens in said token chute are free to fall in response to the disengagement of the two sleeves permitting the outer sleeve to telescope relative to the fixed, inner sleeve to provide sufficient clearance for removal of the collection box.

2. The slot machine anti-jamming device of claim 1, wherein the locking means is a set screw.

3. The slot machine anti-jamming device of claim 1, wherein the first and second tubular members are fabricated from plastic.

4. The slot machine anti-jamming device of claim 3, wherein the plastic is polyvinyl chloride.

* * * * *